United States Patent [19]

McCullough

[11] Patent Number: 4,976,189

[45] Date of Patent: Dec. 11, 1990

[54] MOTION TRANSLATING DEVICE

[76] Inventor: Ross M. McCullough, 4101 Bath Road, Kingston, Ontario, Canada, K7M 4Y8

[21] Appl. No.: 374,756

[22] Filed: Jul. 3, 1989

[51] Int. Cl.[5] ..... F01B 3/10

[52] U.S. Cl. ..... 91/476; 74/52; 74/63

[58] Field of Search ..... 74/52, 63; 91/472, 476

[56] References Cited

U.S. PATENT DOCUMENTS

| | | | |
|---|---|---|---|
| 1,516,948 | 11/1924 | Benedix | 91/476 |
| 2,652,035 | 9/1953 | Bayer | 91/476 |
| 2,783,657 | 3/1957 | Kohlhagen | 74/63 |
| 4,004,498 | 1/1977 | Aoki | 91/476 |
| 4,658,703 | 4/1987 | Greene | 91/476 |

FOREIGN PATENT DOCUMENTS

| | | | |
|---|---|---|---|
| 880752 | 4/1943 | France | 91/472 |

*Primary Examiner*—A. Michael Chambers

[57] ABSTRACT

A motion translating device that includes two or more units mounted on a shaft supported for rotation on a frame. The units are equi-spaced circumferentially about the shaft for balance of the rotating system and each includes arms secured to and radiating outwardly from the shaft, a crank arm journaled on such arms and a fluid actuated piston cylinder unit anchored at one end to the shaft for limited oscillatory movement thereon and at the other end connected to the crank portion of the crank arm. Rotation of the crank arm is resisted preferably selectively by an adjustably variable force. Pressurized fluid flows through said shaft to and from the piston cylinder units with rotary couplings providing connection to a pressure source external to the device. There is a sequence and control valve for the units preferably one for each pair of units controlling flow of fluid to and from the piston cylinder units and in timed relation with and in response to rotation of the crank shaft.

9 Claims, 4 Drawing Sheets

MOTION TRANSLATING DEVICE

FIELD OF INVENTION

This invention relates to a motion translating device and more particularly to the conversion of reciprocating motion of a power unit such as a hydraulic or pneumatic cylinder to rotary motion. The invention also particularly relates to a multiplicity of power units with a common output drive.

The arrangements to be described hereinafter has utility in the form of a variable speed drive a rotating output shaft that can be used to drive other equipment. A multiplicity of power units drive a common shaft which can be in the form of a positive or a soft drive relying on the equal and opposite reaction for motion. The drive can also incorporate speed reduction means or a variable speed drive as indicated with some loss due to friction.

SUMMARY OF THE INVENTION

An object of the invention is to provide a motion translating device that has a wide application and has a variable speed output shaft.

In accordance with the present invention there is provided a motion translating device comprising a frame; a main shaft journaled on said frame for rotation; and at least two units mounted on said shaft for rotation therewith, said pair of units being equi-spaced circumferentially for balance. Each unit comprises arms rigidly secured to and radiating outwardly from said main shaft; a crank arm journaled on said arm for rotation about an axis parallel to said main shaft and a fluid actuated piston cylinder unit anchored at one end to said main shaft for limited oscillatory movement thereon and at the other end connected to the crank of said crank arm. Means is provided for resisting, preferably with selective varying force, rotation of the crank arm. Fluid flows via passage means through the main shaft to and from said piston cylinder units and rotary couplings provide connection to a pressure source external to said device. Sequence and control valve means controls flow of fluid to and from the piston cylinder units and are actuated in response to rotation of the crank shaft.

In accordance with another aspect of the present invention there is provided a power drive comprising an output main shaft journaled for rotation on suitable support means and a plurality of power units each having a driven rotary shaft; said power units being secured to said main shaft and located at a selected radial distance therefrom; said power unit shafts being parallel to and off-set from the main shaft and reaction force means, operative between said power units and said main shaft whereby said power units cause said main shaft to rotate.

LISTS OF DRAWINGS

The invention is illustrated by way of example in the accompanying drawings wherein.

DESCRIPTION OF PREFERRED EMBODIMENT

Figure 1:
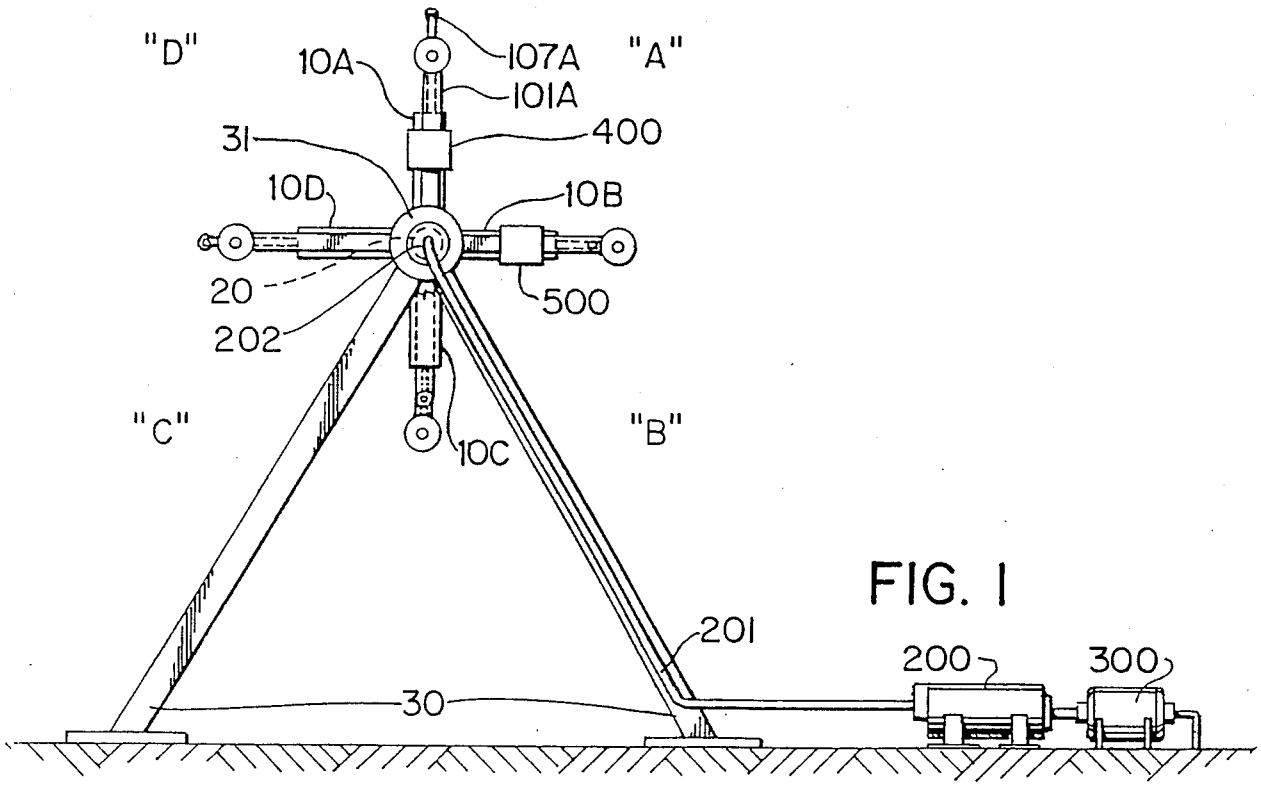
FIG. 1 is a side elevational view of a device constructed in accordance with the present invention.

Referring to the drawings, there is illustrated in FIG. 1 four piston cylinder hydraulic units 10A, 10B, 10C and 10D, each anchored at one end thereof to a main shaft 20 so as to rotate therewith and at the same time oscillate thereabout through a selected arc. The main shaft 20 is journaled for rotation on a rigid structure 30 by way of appropriate journals designated 31 and 32. The hydraulic cylinder units 10A, 10B. 10C and 10D radiate outwardly from the shaft, at a position 90° from one another so as to effectively constitute four quadrants.

Each of the four quadrant units are identical and are identified in FIG. 1 as A, B, C and D and since each is identical, only one will be described. While in the illustrated embodiment there are four units it is to be understood there may be two or more with the maximum number limited by the available space. The units (there being at least two) are equi-spaced from one another circumferentially around the main shaft providing balance for the rotating system. Preferably the units are in pairs diametrically opposite one another, but this need not be so.

Referring now to quadrant unit designated "A", it comprises the hydraulic piston cylinder unit 10A, a pair of arms 101A, a crank arm 107A journaled on such arms and means for resisting rotation of crank arm about its axis. The piston cylinder unit 10A is anchored at one end to the shaft 20 for limited oscillation thereabout as the shaft rotates and at the other end is anchored to the crank portion of a crank arm 107A. The crank portion of crank arm 107A is located between the pair of arms 101A such arms being apart from one another in a direction longitudinally along the axis of the shaft 20. The arms are rigidly secured to the shaft 20 for rotation therewith. The cylinder unit 10a is double acting and by a valve arrangement and suitable control thereof pressurized fluid to the cylinder causes the piston rod thereof to reciprocate and thereby apply force tending to rotate the crank arm. Resisting rotation of the crank arm causes the unit to rotate as a whole with rotation being about the axis of shaft 20.

The main shaft 20 has a passage therethrough which carries fluid under pressure to and from the hydraulic cylinders 10A, 10B, 10C and 10D. Fluid pressure is provided by a hydraulic pump 200, driven by an electric motor 300, fluid from the pump 200 being by way of line 201, to a passage in the shaft 20 with connection thereto being by a rotary fluid coupling 202. The fluid flow for opposed hydraulic cylinder units 10A and 10C is controlled by a first valve 400 actuated by a cam or some other means, in response to rotation of the crank shaft 107A associated therewith and in timed relation therewith. The pair of cylinder units 10B and 10D are controlled by a similar second valve unit 500.

Timing of two opposed cylinder units is such that one is pulling while the other is pushing on the crank arm. With the four units, two will be pushing while the other two are pulling. Preferably two of the units are somewhat out of phase with the other two as to avoid having a stall point at the top and/or bottom dead centre of the pistons. Fluid is diverted by solenoid actuated valves 400 and 500 as required through actuation of the solenoids by interrupting circuits to the solenoids. For this purpose the circuits are through split rings or commutators on the crank shaft associated therewith. For example, valve unit 400 is controlled by commutator 401 which makes and breaks circuit 402 to the solenoid of valve unit 400 as the shaft 107A associated therewith rotates.

Appropriate positioning of the split rings provides the required sequencing or timing for the valves. The hydraulic circuits from the respective valves discharge back to a sump 204 via line 205 from a rotary coupling 203 on the end of shaft 20 opposite to the inlet end rotary coupling 202. In place of sump 204 the return line can be directly back to the pump providing a closed loop path.

Figure 2:
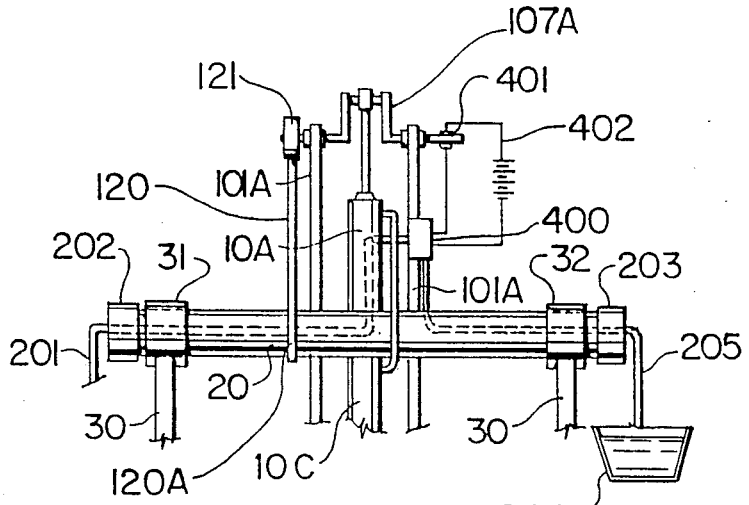
FIG. 2 is a partial, vertical, sectional, elevational view taken essentially along line 2-2 of FIG. 1.

The assembly comprising shaft 20 and quadrant units A, B, C and D rotate in unison on frame 30 and the rotation is controlled by resisting rotation of the crank arm preferably by a selective variable resistance. In FIG. 2, rotation of the crank arm 107A is shown impeded by an arm 120 secured thereto as by unit 121 with such arm 120 at the other end designated 120A abutting shaft 20. Unit 121 can be a rigid coupling or alternatively a friction type slip clutch or limited slip fluid coupling.

Figure 3:
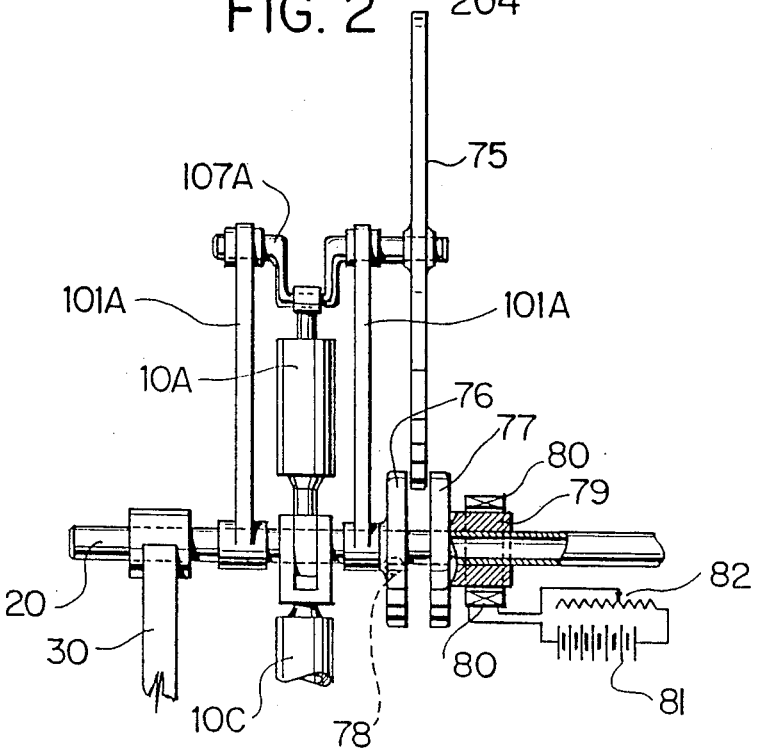
FIG. 3 is a partial view similar to FIG. 1 illustrating a modified brake arrangement.
Figure 4:
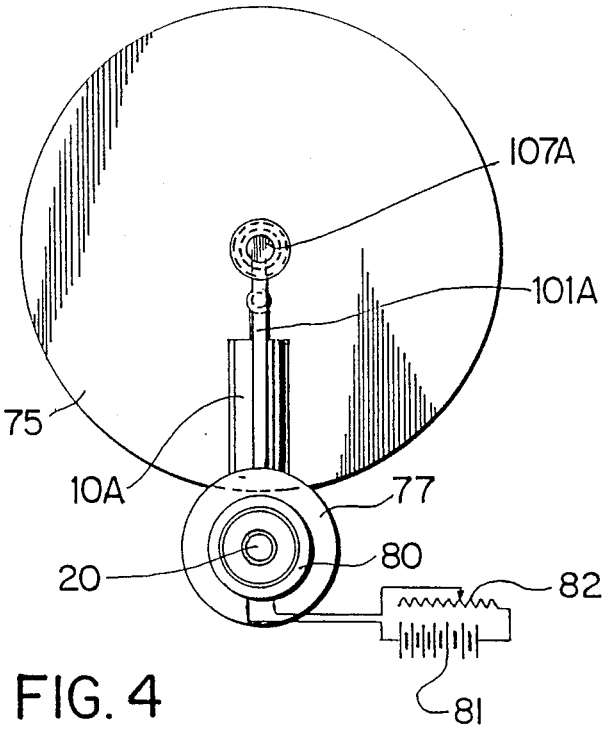
FIG. 4 is a righthand partial elevational view of FIG. 3.

An alternative brake arrangement for impeding rotation of the crank arm is shown in FIGS. 3 and 4 and referring to these figures there is in partial view a main shaft 20 as in FIG. 1 supported by journals on a frame 30. Also there is a crank arm 107A journaled on a rigid arm 101A secured to and radiating outwardly from the main shaft 20. Only one arm 101A is shown and in some circumstances would be adequate but preferably there are two arms with the crank portion of shaft 107A being located therebetween.

A disc 75 is secured to shaft 101A for rotation therewith and an outer portion near the periphery thereof is located between a pair of disc plates 76 and 77 mounted on the main shaft 20. Disc plate 76 is fixed to the shaft 20 for rotation therewith by a woodruff key 78 or a set screw or the like. Disc plate 77 is slidable on shaft 20 in a direction toward and away from disc plate 76 so as to clamp, with selectively variable force, the disc 75 between the pair of plates. The disc plate 77 has a hub 79 that projects into a cylindrical solenoid coil 80. Coil 80 is selectively activated by current from a power source 81 through a relostat 82 to cause disc plate 77 to move toward disc plate 76. When the coil is deactivated the movable disc plate 77 can be returned to its initial position by spring pressure or merely by reversal or polarity of the electrical circuit to the coil.

A disc 75 is associated with each of the resepective crank arms of units 10A, 10B, 10C and 10D and each has a portion thereof projecting between the disc plates 76 and 77. In other words there is only one pair of disc plates which is used to apply a braking force for the discs of all of the crank arms. If desired there could, however, be a separate pair of disc plates for each of the rotating crank arms having a disc mounted thereon. Alternatively means could be provided (i.e. sprockets and a link chain) so as to cause all crank arms to rotate in unison with the driving (or braking) force of one transferred to all of the others and in which case only one disc 75 would be required.

Figure 5:
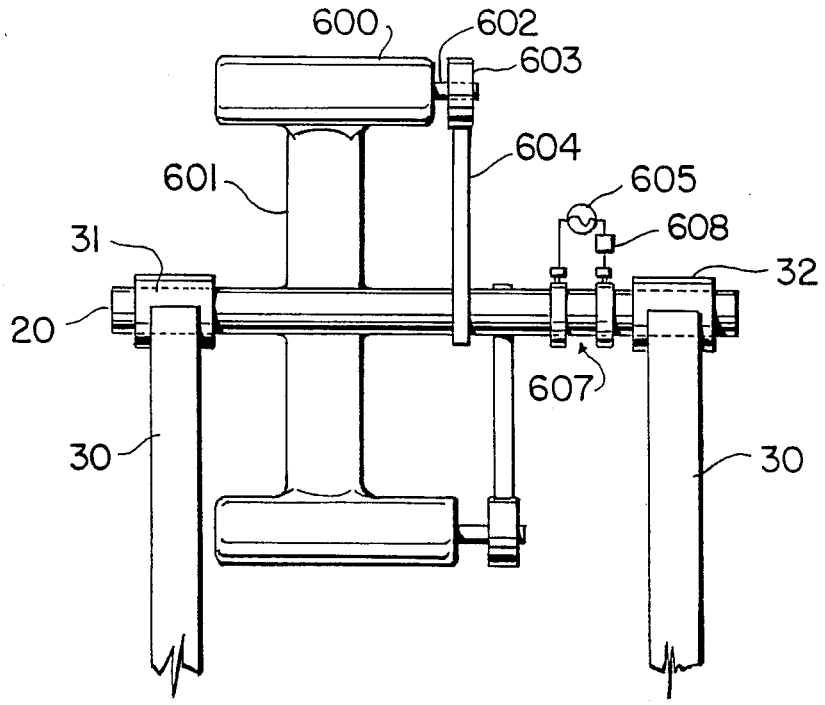
FIG. 5 is a partial elevational view, similar to FIG. 3, but illustrating a modified embodiment.

Referring to FIG. 5, there is illustrated two electric motors 600 attached to shaft 20 for rotation therewith by an arm or post 601. The post is rigidly secured as by welding or other means to the shaft. Each motor has a rotating shaft 602 connected to a speed reduction unit 603, i.e. a planetary gear unit with an outer rotatable housing. A reaction arm 604 is rigidly secured to the housing and abuts against the shaft 20. Power for the electric motors is supplied from a source 605 by way of slip ring 607 on the shaft. The speed of the motors, if desired, can be controlled by a rheostat type or power control unit 608. In FIG. 5, only two electric motors are shown mounted on the shaft, but it is intended there be numerous motors equi-spaced circumferentially around the shaft.

I claim:

1. A motion translating device comprising:

(a) a frame;

(b) a main shaft journaled on said frame for rotation;

(c) at least two units mounted on said main shaft for rotation therewith, said units being equi-spaced from one another circumferentially around said main shaft and each comprising:

(i) a rigid arm secured to and radiating outwardly from said main shaft;

(ii) a crank arm journaled on said rigid arm for rotation about an axis parallel to and offset from the axis of rotation of said main shaft; and (iii) a fluid actuated piston cylinder unit anchored at one end to said main shaft for limited oscillatory movement thereon and at the other end connected to the crank portion of said crank arm;

(d) means for resisting rotation of said crank arm;

(e) fluid flow passage means through said shaft to said piston cylinder units including rotary couplings for connection to a pressure source external to said device; and (f) sequence and control valve means controlling flow of fluid to and from said piston cylinder units and in response to rotation of said crank arm shaft.

2. A device as defined in claim 1 including pairs of the same identical units mounted on said main shaft, said units in each of the respective pairs being diametrically opposite one another and including a sequence and control valve means for each pair of said units.

3. A device as defined in claim 1 wherein said means resisting rotation of said crank arm comprises a disc secured to the shaft of said crank arm for rotation therewith and means on said main shaft operative to resist rotation of said disc.

4. A device as defined in claim 3 wherein said means on said main shaft resisting rotation of the disc comprises a disc plate movably mounted in said main shaft selectively to engage the disc on said crank shaft.

5. A motion translating device comprising:

(a) a frame;

(b) a main shaft journaled on said frame for rotation;

(c) two or more units mounted on said main shaft for rotation therewith and equally spaced from one another circumferentially around said shaft, each said unit comprising:

(i) a pair or rigid arms mounted on and radiating outwardly from said main shaft, said arms being spaced apart from one another axially along said main shaft;

(ii) a crank arm journaled on said arms for rotation about an axis parallel to and offset from the axis of rotation of said main shaft, said crank arm having the crank portion thereof located between said pair of rigid arms; and (iii) a fluid actuated piston cylinder unit anchored at one end to said main shaft for limited oscillatory movement thereon and at the other end connected to the crank portion of said crank arm;

(d) means for selectively resisting rotation of said crank arm including means to selectively vary the force of resistance;

(e) fluid flow passage means to and from said piston cylinder units including rotary couplings for connection to a fluid pressure source external to said device; and (f) sequence and control valve means controlling flow of fluid to and from said piston cylinder units and in response to rotation of said crank arm shaft.

6. A device as defined in claim 5 wherein said means to selectively resist rotation of said crank arm comprises a disc secured to said the shaft of said crank arm for rotation therewith and a disc plate on said main shaft, said disc plate being rotatable with and moveable into and out of engagement with said disc and thereby operative to resist rotation of said crank arm shaft.

7. A device as defined in claim 6 including a pair of disc plates on said main shaft with at least one moveable toward and away from the other to selectively grip therebetween an outer peripheral edge portion of said disc on the crank arm shaft.

8. A power drive comprising:

(a) an output main shaft journaled for rotation on suitable support means;

(b) a plurality of power units, each having a driven rotary shaft, said power driven units being rigidly secured to said main shaft for rotation therewith, the driven rotary shafts of said power units being at a selected radially distance from said main shaft and parallel thereto; and (c) reaction force means operative between said power units and said main shaft whereby said power units cause said main shaft to rotate with the power units rotating in unison with the main shaft.

9. A power drive unit as defined in claim 8 wherein said reaction force means comprises a speed reduction unit driven pg,14 by the shaft of the motor and having an outer housing and including a reaction arm secured to said housing and engaging said output main shaft.

* * * * *